US011268212B2

(12) United States Patent
Agarwal

(10) Patent No.: US 11,268,212 B2
(45) Date of Patent: Mar. 8, 2022

(54) PARTIALLY ORIENTED YARN (POY) GENERATION USING POLYETHYLENE TEREPHTHALATE (PET) BOTTLE FLAKES

(71) Applicant: Arun Agarwal, Dallas, TX (US)

(72) Inventor: Arun Agarwal, Dallas, TX (US)

( * ) Notice: Subject to any disclaimer, the term of this patent is extended or adjusted under 35 U.S.C. 154(b) by 44 days.

(21) Appl. No.: 16/790,722

(22) Filed: Feb. 13, 2020

(65) Prior Publication Data

US 2021/0254242 A1 Aug. 19, 2021

(51) Int. Cl.

| | |
|---|---|
| ***D01D 5/096*** | (2006.01) |
| ***D01D 1/10*** | (2006.01) |
| ***D02J 11/00*** | (2006.01) |

(52) U.S. Cl.

CPC ..... *D01D 5/096* (2013.01); *D01D 1/106* (2013.01); *D02J 11/00* (2013.01); *D10B 2331/04* (2013.01)

(58) Field of Classification Search

CPC .. D01D 5/096; D01D 1/10; D01D 5/08; D02J 11/00

See application file for complete search history.

(56) References Cited

U.S. PATENT DOCUMENTS

| | | | | |
|---|---|---|---|---|
| 4,534,164 | A * | 8/1985 | Toshimasa | D02G 1/022 57/282 |
| 5,559,159 | A * | 9/1996 | Sublett | C08J 11/22 521/48.5 |
| 6,261,080 | B1 * | 7/2001 | Schroter | D01D 4/06 425/378.2 |
| 7,108,500 | B2 | 9/2006 | Bacher et al. | |
| 7,981,941 | B2 | 7/2011 | Friedlaender et al. | |
| 10,487,422 | B2 | 11/2019 | Clark | |
| 10,695,953 | B2 | 6/2020 | Clark | |
| 2002/0130433 | A1 * | 9/2002 | Hwo | D01D 5/16 264/103 |
| 2003/0064650 | A1 * | 4/2003 | Van Trump | D04H 3/02 442/352 |

(Continued)

FOREIGN PATENT DOCUMENTS

| | | | |
|---|---|---|---|
| CN | 201136915 | Y | 10/2008 |
| CN | 1936126 | A | 4/2009 |

(Continued)

*Primary Examiner* — Xiao S Zhao
*Assistant Examiner* — Emmanuel S Luk
(74) *Attorney, Agent, or Firm* — LegalForce RAPC Worldwide

(57) ABSTRACT

A method includes charging PET bottle flakes having particular characteristics as a raw material into a crystallizer to generate a crystalline version thereof, drying the crystalline version with dehumidified air at a temperature of 160-180° C. and with a dew point of −40° C. to bring down a moisture level thereof below 100 ppm, melting the dried crystalline version through an extruder configured to have a temperature therein maintained at 285-295° C., and feeding the melted raw material into a spin beam. The method also includes generating, through a spinneret, a number of filaments based on extruding, through the spinneret, the melted raw material fed into the spin beam, forming a yarn based on combining the number of filaments, and winding the formed yarn to generate a spool of Partially Oriented Yarn (POY) configured to be utilized as another raw material to generate a Draw Texturized Yarn (DTY).

20 Claims, 4 Drawing Sheets

(56) References Cited

U.S. PATENT DOCUMENTS

| | | | | |
|---|---|---|---|---|
| 2004/0155374 | A1* | 8/2004 | Hutchinson | B29B 17/0412 264/40.1 |
| 2007/0052131 | A1* | 3/2007 | Fujimaki | B29B 9/12 264/210.7 |
| 2010/0152311 | A1* | 6/2010 | Booth | C08J 11/04 521/48 |
| 2010/0201015 | A1* | 8/2010 | Fujimaki | C08G 63/916 264/50 |
| 2011/0054092 | A1* | 3/2011 | Kurachi | C08L 67/02 524/139 |
| 2011/0092627 | A1* | 4/2011 | Jen | C08K 9/02 524/410 |
| 2011/0152419 | A1* | 6/2011 | Jen | C08K 3/22 524/131 |
| 2012/0141723 | A1* | 6/2012 | Chuah | D01F 6/62 428/85 |
| 2014/0008368 | A1* | 1/2014 | Severini | B65D 77/2024 220/359.3 |
| 2014/0094078 | A1* | 4/2014 | Feng | D04H 3/033 442/337 |
| 2016/0166727 | A1* | 6/2016 | Ganatra | D01D 5/08 424/1.11 |
| 2016/0251777 | A1* | 9/2016 | Kim | D01D 5/253 139/420 R |
| 2018/0127893 | A1 | 5/2018 | Clark | |
| 2020/0055213 | A1* | 2/2020 | Clark | B29B 13/065 |
| 2020/0063296 | A1* | 2/2020 | Ozden | D02G 3/04 |
| 2020/0208759 | A1* | 7/2020 | Iaciofano | F16L 11/12 |
| 2020/0392646 | A1* | 12/2020 | Park | D01D 4/00 |

FOREIGN PATENT DOCUMENTS

| | | | |
|---|---|---|---|
| CN | 100473764 | C | 4/2009 |
| CN | 100480442 | C | 4/2009 |
| CN | 101550608 | A | 10/2009 |
| CN | 101638813 | A | 2/2010 |
| CN | 101144191 | B | 5/2010 |
| CN | 101435113 | A | 10/2010 |
| CN | 101928992 | A | 12/2010 |
| CN | 101935895 | A | 1/2011 |
| CN | 102168320 | A | 8/2011 |
| CN | 102605455 | A | 7/2012 |
| CN | 101476213 | B | 12/2012 |
| CN | 102605454 | B | 3/2013 |
| CN | 103194809 | A | 7/2013 |
| CN | 103215676 | A | 7/2013 |
| CN | 103305958 | A | 9/2013 |
| CN | 103572391 | A | 2/2014 |
| CN | 103668511 | A | 3/2014 |
| CN | 104073906 | A | 10/2014 |
| CN | 104264287 | B | 5/2015 |
| CN | 103911681 | B | 12/2015 |
| CN | 105401253 | A | 3/2016 |
| CN | 105350097 | B | 1/2018 |
| CN | 105755569 | B | 7/2018 |
| CN | 109423699 | A | 3/2019 |
| EP | 2450480 | A1 | 5/2012 |
| TW | 201209239 | A | 3/2012 |
| WO | 2017092071 | A1 | 6/2017 |

* cited by examiner

PARTIALLY ORIENTED YARN (POY) GENERATION USING POLYETHYLENE TEREPHTHALATE (PET) BOTTLE FLAKES

FIELD OF TECHNOLOGY

This disclosure relates generally to textiles and, more particularly, to methods, a device and/or a system of Partially Oriented Yarn (POY) generation using Polyethylene Terephthalate (PET) bottle flakes.

BACKGROUND

PET bottles may constitute a significant component of recyclable packaging materials. Flakes of PET bottles may be commercially available in the market in bags. However, reuse of the PET bottles for target applications by way of processing said flakes may be limited based on properties thereof.

SUMMARY

Disclosed are methods, a device and/or a system of Partially Oriented Yarn (POY) generation using Polyethylene Terephthalate (PET) bottle flakes.

In one aspect, a method includes selecting Polyethylene Terephthalate (PET) flakes from bottles having an intrinsic viscosity ranging from 0.748 to 0.752, a b color value of <1.0 in accordance with an L, a, b color scale, an L color value of >60 in accordance with the L, a, b color scale, and a transparent appearance as a raw material, charging the selected raw material into a crystallizer to generate a crystalline version thereof, drying the crystalline version of the raw material with dehumidified air at a temperature of 160-180° C. and with a dew point of −40° C. to bring down a moisture level thereof below 100 parts per million (ppm), and melting the dried crystalline version of the raw material through an extruder configured to have a temperature therein maintained at 285-295° C.

The method also includes feeding the melted raw material into a spin beam configured to have a consistent temperature and a consistent pressure of the fed melted raw material maintained therein, generating, through a spinneret associated with the spin beam, a number of filaments based on extruding, through the spinneret, the melted raw material fed into the spin beam, forming a yarn based on combining the number of filaments extruded through the spinneret, and winding the formed yarn to generate a spool of Partially Oriented Yarn (POY) configured to be utilized as another raw material to generate a Draw Texturized Yarn (DTY).

In another aspect, a method includes selecting PET flakes from bottles having an intrinsic viscosity ranging from 0.748 to 0.752, a b color value of <1.0 in accordance with an L, a, b color scale, an L color value of >60 in accordance with the L, a, b color scale, and a transparent appearance as a raw material, charging the selected raw material into a crystallizer to generate a crystalline version thereof, drying the crystalline version of the raw material with dehumidified air at a temperature of 160-180° C. and with a dew point of −40° C. to bring down a moisture level thereof below 100 ppm, and melting the dried crystalline version of the raw material through an extruder configured to have a temperature therein maintained at 285-295° C.

The method also includes feeding the melted raw material into a spin beam configured to have a consistent temperature and a consistent pressure of the fed melted raw material maintained therein, generating, through a number of spinnerets associated with the spin beam, a number of filaments through each spinneret based on extruding, through the each spinneret, the melted raw material fed into the spin beam, forming a yarn based on combining the number of filaments extruded through the each spinneret with the number of filaments extruded through other spinnerets of the number of spinnerets, and winding the formed yarn to generate a spool of POY configured to be utilized as another raw material to generate a DTY.

In yet another aspect, a method includes selecting PET flakes from bottles having an intrinsic viscosity ranging from 0.748 to 0.752, a b color value of <1.0 in accordance with an L, a, b color scale, an L color value of >60 in accordance with the L, a, b color scale, and a transparent appearance as a raw material, charging the selected raw material into a crystallizer to generate a crystalline version thereof, drying the crystalline version of the raw material with dehumidified air at a temperature of 160-180° C. and with a dew point of −40° C. to bring down a moisture level thereof below 100 ppm, and melting the dried crystalline version of the raw material through an extruder configured to have a temperature therein maintained at 285-295° C.

The method also includes passing the melted raw material through a filter capable of removing particles up to 40 microns in dimension, feeding the filtered and melted raw material into a spin beam configured to have a consistent temperature and a consistent pressure of the fed filtered and melted raw material maintained therein, generating, through a spinneret associated with the spin beam, a number of filaments based on extruding, through the spinneret, the filtered and melted raw material fed into the spin beam, forming a yarn based on combining the number of filaments extruded through the spinneret, and winding the formed yarn to generate a spool of POY configured to be utilized as another raw material to generate a DTY.

The methods and systems disclosed herein may be implemented in any means for achieving various aspects. Other features will be apparent from the accompanying drawings and from the detailed description that follows.

BRIEF DESCRIPTION OF THE DRAWINGS

The embodiments of this invention are illustrated by way of example and not limitation in the figures of the accompanying drawings, in which like references indicate similar elements and in which.

Other features of the present embodiments will be apparent from the accompanying drawings and from the detailed description that follows.

DETAILED DESCRIPTION

Disclosed are methods, a device and a system of Partially Oriented Yarn (POY) generation using Polyethylene Terephthalate (PET) bottle flakes. Although the present embodiments have been described with reference to specific example embodiments, it will be evident that various modifications and changes may be made to these embodiments without departing from the broader spirit and scope of the various embodiments.

Figure 1:
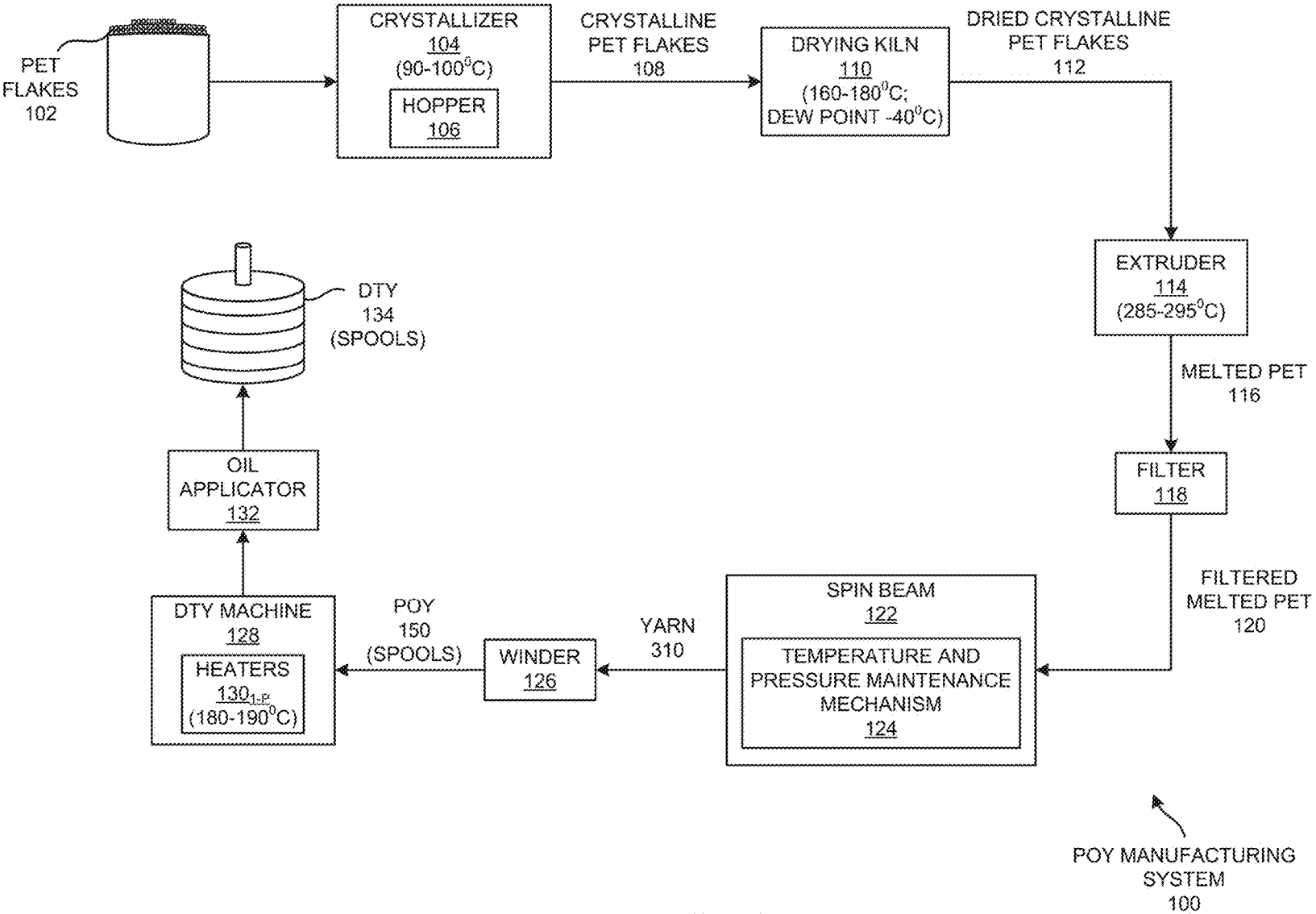
FIG. 1 is a schematic view of a Partially Oriented Yarn (POY) manufacturing system configured to generate a POY from Polyethylene Terephthalate (PET) bottle flakes, according to one or more embodiments.

FIG. 1 shows a Partially Oriented Yarn (POY) manufacturing system 100 configured to generate a POY 150 from Polyethylene Terephthalate (PET) bottle flakes, according to one or more embodiments. In one or more embodiments, market available PET flakes made by crushing used PET bottles that are further washed, dried and cut into small pieces (e.g., 0.5 inches×0.5 inches) may be chosen as a raw material for the aforementioned purpose. In one or more embodiments, desired properties of the PET flakes may include but are not limited to an intrinsic viscosity of 0.750±0.02 (0.748 to 0.752), a b color value (in accordance with the L, a, b color scale) of <1.0, an L color value of >60 in accordance with the L, a, b color scale and/or a transparent appearance. PET flakes with a molecular weight of 16,000 to 19,000 Daltons (Da) and an intrinsic viscosity of ~0.750 may have the intrinsic viscosity fall to ~0.620 as a result of spinning operations inherent in a manufacturing process associated with the generation of POY 150 through POY manufacturing system 100. To account for the fall in viscosity, in one or more embodiments, the choice of PET flakes with an intrinsic viscosity of 0.750±0.02 may be justified.

The b color value may indicate a degree of yellowness (or, at the opposite end, blueness). In one or more embodiments, for better dyeability, a b color value of <1.0 of the PET flakes may be preferable. The L color value may indicate a degree of lightness, which, in turn, is indicative of luster. In one or more embodiments, an L color value of >60, characteristic of a reasonable degree of luster of the PET flakes, may be preferred. PET flakes are well known to one skilled in the art. Detailed discussion and description associated therewith has, therefore, been skipped for the sake of convenience, brevity and clarity.

FIG. 1 shows a packed bag of PET flakes as PET flakes 102. In one or more embodiments, PET flakes 102 may have the characteristics discussed above. In one or more embodiments, said PET flakes 102 may be charged into a crystallizer 104 and pneumatically conveyed therethrough. In one or more embodiments, crystallizer 104 may include a hopper 106 associated therewith into which PET flakes 102 may be charged. FIG. 1 shows hopper 106 as part of crystallizer 104 merely for the sake of illustrative convenience. Typically, hopper 106 may be a cylindrical bin with a conical bottom. Other types of hopper 106 are within the scope of the exemplary embodiments discussed herein.

In one or more embodiments, the charged PET flakes 102 may be heated with warm air to a temperature (90-100° C., the temperature of crystallizer 104) at which the charged PET flakes 102 are modified into aligned crystalline/semi-crystalline structures. Warm air may rise from a bottom of hopper 106 to a top of hopper 106, taking away moisture from the charged PET flakes 102 therewith. In the specific embodiment of crystallizer 104 with hopper 106 having a conical bottom, at the same time the hot air rises upward in hopper 106, the heated charged PET flakes 102 may be conveyed downward and downstream for further processing. In one or more embodiments, crystallization may depend on the temperature and the duration of heating. In some embodiments, in order to prevent clumping of the crystallizing PET flakes, an agitator (not shown) may be provided in the non-conical portion of hopper 106, on top of which PET flakes 102 may be continuously fed.

FIG. 1 shows the output of crystallizer 104 as crystalline PET flakes 108. In one or more embodiments, as the abovementioned heating may not be sufficient to address significant moisture removal requirements, crystalline PET flakes 108 (or, semi-crystalline PET flakes 108) may still tend to agglomerate. Further, remnant moisture in crystalline PET flakes 108 may result in loss of intrinsic viscosity thereof. In one or more embodiments, to prevent the aforementioned clumping/agglomeration/loss of intrinsic viscosity, crystalline PET flakes 108 may further be dried (e.g., through a drying kiln 110) with dehumidified air at a temperature of 160-180° C. and with a dew point of −40° C. to bring down moisture levels of crystalline PET flakes 108 below 100 parts per million (ppm).

It should be noted that in some embodiments, a separate drying kiln 110 may not be required. The drying process to bring down moisture levels below 100 ppm may be accomplished solely using crystallizer 104/hopper 106 based on specially designed operations therethrough. Such variations are within the scope of the exemplary embodiments discussed herein. In one or more embodiments, the moisture removal discussed above may also prevent hydraulic degradation of the crystalline PET flakes 108 and, consequently, provide for consistency in properties of a fabric derived therefrom.

It should be noted that the temperature of crystallization discussed above may be below the melting point of PET flakes 102. In one or more embodiments, the dried crystalline PET flakes 112 (the output of the drying process (e.g., through drying kiln 110) discussed above) may be fed into an extruder 114 where a temperature of 285-295° C. is maintained. In one or more embodiments, extruder 114 may include a screw to transport the dried crystalline PET flakes 112 to an outlet thereof. In one or more embodiments, the screw may aid in mixing the dried crystalline PET flakes 112 into compact masses and in melting said dried crystalline PET flakes 112. In one or more embodiments, friction between the dried crystalline PET flakes 112 and a wall of a barrel surrounding the screw may generate heat that supplements the heat conducted from the wall of the barrel to the dried crystalline PET flakes 112, thereby enabling formation of a PET film surrounding the wall of the barrel. In one or more embodiments, this, coupled with the flighting/movement of the screw, may stretch the dried crystalline PET flakes 112 enough to melt said dried crystalline flakes 112.

Figure 2:
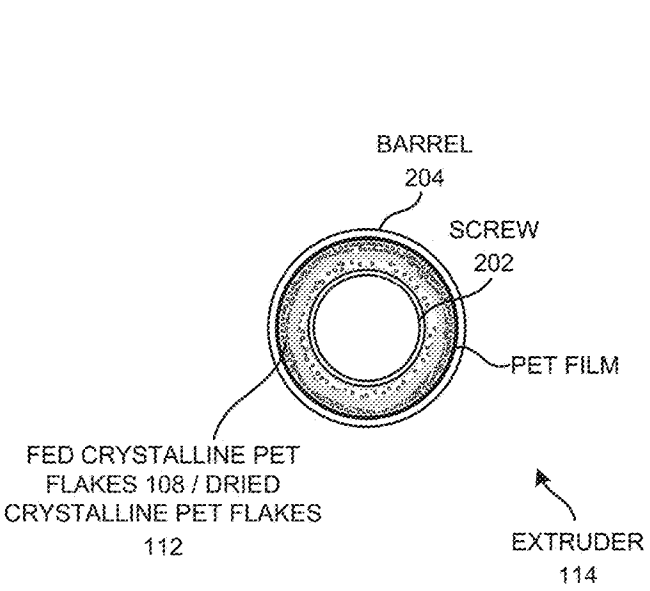
FIG. 2 is a schematic view of an example extruder of the POY manufacturing system of FIG. 1.
Figure 2:
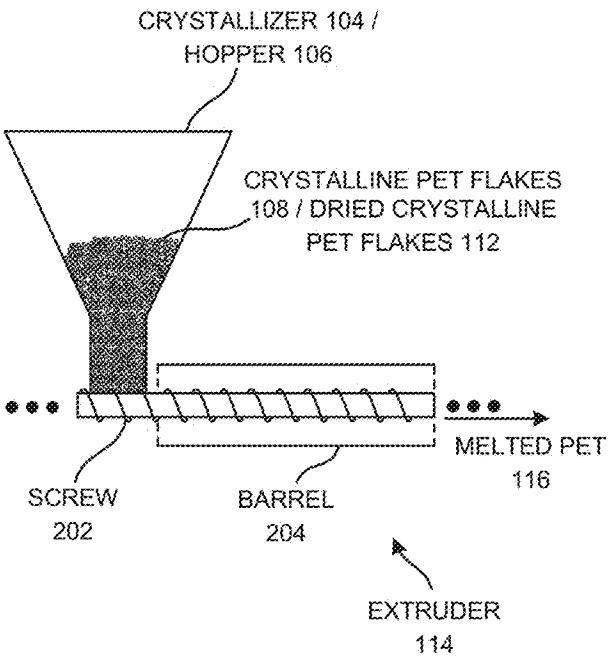

FIG. 1 shows the output of extruder 114 as melted PET 116. FIG. 2 shows an example extruder 114 including a single screw 202 housed within a barrel 204. In order to illustrate the mechanism of screw 202, barrel 204 has been opened up to reveal screw 202 in FIG. 2. FIG. 2 also shows a cross-sectional view of extruder 114 with barrel 204 surrounding screw 202. As shown in FIG. 2, the output of crystallizer 104/hopper 106, viz. crystalline PET flakes 108 (or, the subsequently dried version thereof, viz. dried crystalline PET flakes 112), may be fed into extruder 114. As discussed above, extruder 114 may cause melting of said crystalline PET flakes 108/dried crystalline PET flakes 112 into a viscous form thereof, which is melted PET 116. It should be noted that extruder 114 may include other parts such as a breaker plate and that such parts are known to one skilled in the art. Detailed discussion associated therewith has, therefore, been skipped for the sake of clarity and convenience.

Further, it should be noted that while FIG. 2 shows a single-screw extruder 114, an extruder including multiple screws and other forms thereof are within the scope of the exemplary embodiments discussed herein. In one or more embodiments, melted PET 116 may be passed through a filter 118 (e.g., a mesh) capable of removing particles as small as (or, up to) 40 microns in dimension. FIG. 1 shows the output of filter 118 as filtered melted PET 120. In one or more embodiments, filtered melted PET 120 may then be fed into a spin beam 122. In one or more embodiments, spin beam 122 may be a box or a container that includes a number of packs and may have a temperature and pressure maintenance mechanism 124 therein whereby a consistent temperature and pressure of filtered melted PET 120/extruded polymer (to be discussed below) is maintained therewithin. In one or more embodiments, each pack may have a spinneret at an end thereof. In one or more embodiments, the spinneret at each pack may have a number of holes therein. In one or more embodiments, the extrusion of filtered melted PET 120 through each spinneret may generate a set of filaments.

Figure 3:
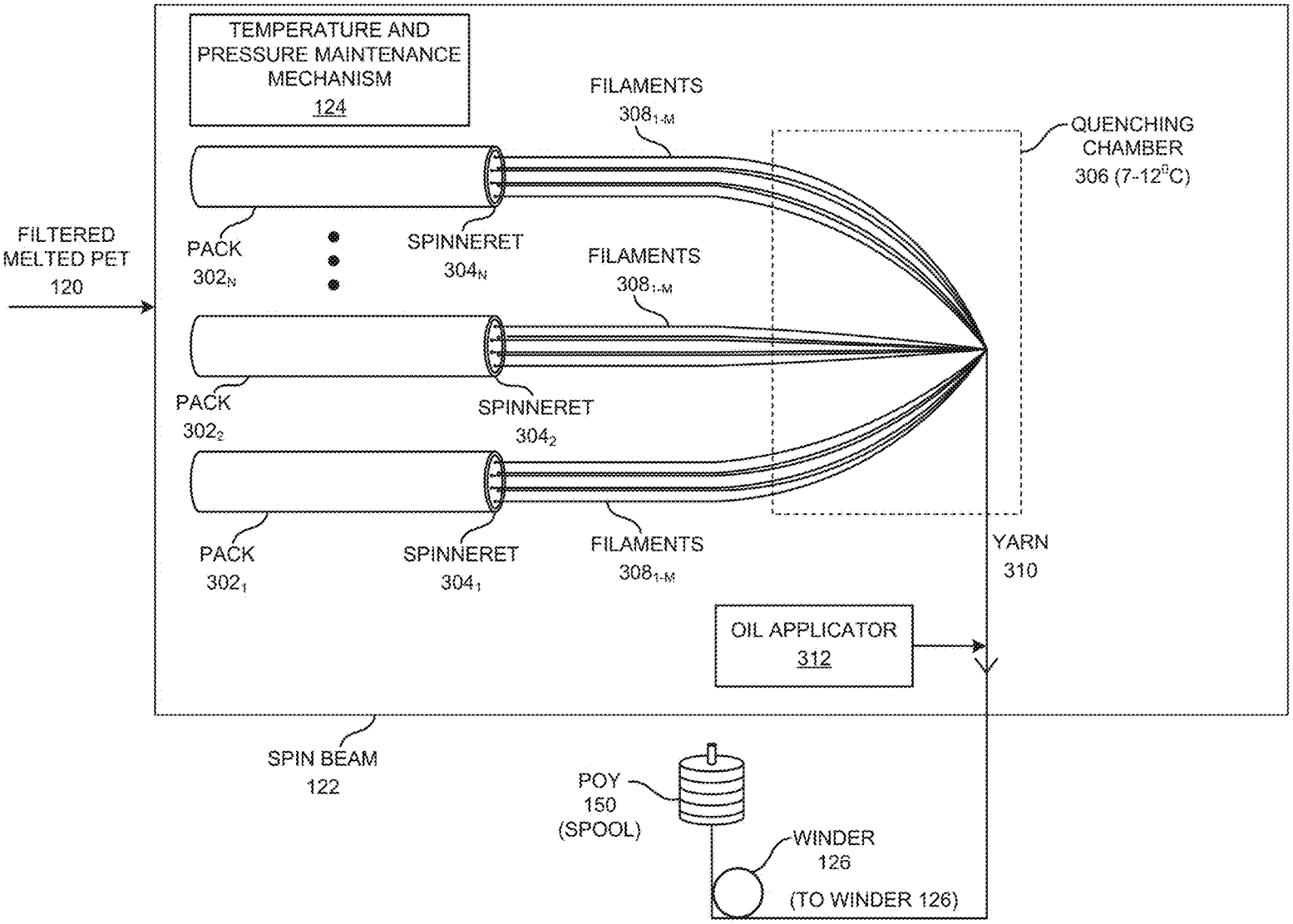
FIG. 3 is an example spin beam of the POY manufacturing system of FIG. 1.

FIG. 3 shows an example spin beam 122. As discussed above, spin beam 122 may include a number of packs $\mathbf{302}_{1\text{-}N}$ and temperature and pressure maintenance mechanism 124. FIG. 3 shows a spinneret $\mathbf{304}_{1\text{-}N}$ at an end of each of the number of packs $\mathbf{302}_{1\text{-}N}$. FIG. 3 also shows filtered melted PET 120 fed into spin beam 122. In one or more embodiments, spin beam 122 may include a quenching chamber 306 associated therewith configured to enable cooling (at a temperature of 7-12° C.) of filaments $\mathbf{308}_{1\text{-}M}$ out of each spinneret $\mathbf{304}_{1\text{-}N}$. FIG. 3 shows quenching chamber 306 as part of spin beam 122; however, quenching chamber 306 may also be distinct from spin beam 122 in some embodiments. In one or more embodiments, filaments $\mathbf{308}_{1\text{-}M}$ out of each spinneret $\mathbf{304}_{1\text{-}N}$ may be combined with filaments $\mathbf{308}_{1\text{-}M}$ out of other spinnerets $\mathbf{304}_{1\text{-}N}$ into a yarn 310 during the quenching (cooling; e.g., air cooling) of all sets of filaments $\mathbf{308}_{1\text{-}M}$ in quenching chamber 306. It should be noted that, in certain embodiments, a number of filaments out of one spinneret $\mathbf{304}_{1\text{-}N}$ may be different from a number of filaments out of another spinneret $\mathbf{304}_{1\text{-}N}$; variations therein are within the scope of the exemplary embodiments discussed herein.

In one or more embodiments, for the finishing, oil may be applied to yarn 310 configured to move in a definite path. For example, a guide (not shown) may be used to facilitate to enable oil application to lubricate all the sets of filaments $\mathbf{308}_{1\text{-}M}$ of yarn 310. In one or more embodiments, the lubrication may reduce friction between filaments $\mathbf{308}_{1\text{-}M}$ of yarn 310. FIG. 3 shows an oil applicator 312 configured to enable the abovementioned application of oil. Oil applicators are well known to one skilled in the art. Detailed discussion associated therewith has, therefore, been skipped for the sake of convenience and clarity. It should be noted that while oil applicator 312 has been shown as part of spin beam 122, oil applicator 312 and associated processes may be distinct therefrom. Further, it should be noted that, in some embodiments, the application of oil may be done prior to the combination of filaments $\mathbf{308}_{1\text{-}M}$ into yarn 310 instead of after the combination thereof.

Referring back to FIG. 1, yarn 310 out of spin beam 122 may be wound on a winder 126 to generate a spool of POY 150. Winder 126 may also be associated (e.g., as a part of spin beam 122) with spin beam 122. In one or more embodiments, said spool of POY 150 may be utilized as a raw material to generate Draw Texturized Yarns (DTYs).

In one or more embodiments, as shown in FIG. 1, one or more spools of POYs 150 may be loaded onto a Draw Texturized machine 128 where a heater temperature of around 180-190° C. is maintained. Again, in one or more embodiments, the loaded yarns may pass through definite yarn paths via heaters (e.g., heaters $\mathbf{130}_{1\text{-}P}$; these may be primary or secondary heaters). In one or more embodiments, antistatic oil may then be applied (e.g., through oil applicator 132) on the yarns. In one or more embodiments, POYs 150 may be drawn with definite draw ratios through one or more heaters $\mathbf{130}_{1\text{-}P}$ to generate a spool of a DTY 134. In one or more embodiments, the resulting DTY 134 may have a denier of 50-500.

In one or more embodiments, DTY 134 may be used as a warp yarn and/or a weft yarn during a weaving process that results in a fabric. In one or more embodiments, DTY 134 may also be used as a warp yarn or a weft yarn in combination with another yarn to generate a fabric of clothing material. Thus, exemplary embodiments provide for a process to generate POY 150 and/or DTY 134 (and/or a subsequent fabric of clothing material) using PET flakes 150 from bottles as a raw material therefor that results in a denier of 50-500 of DTY 134. All reasonable variations are within the scope of the exemplary embodiments discussed herein.

Figure 4:
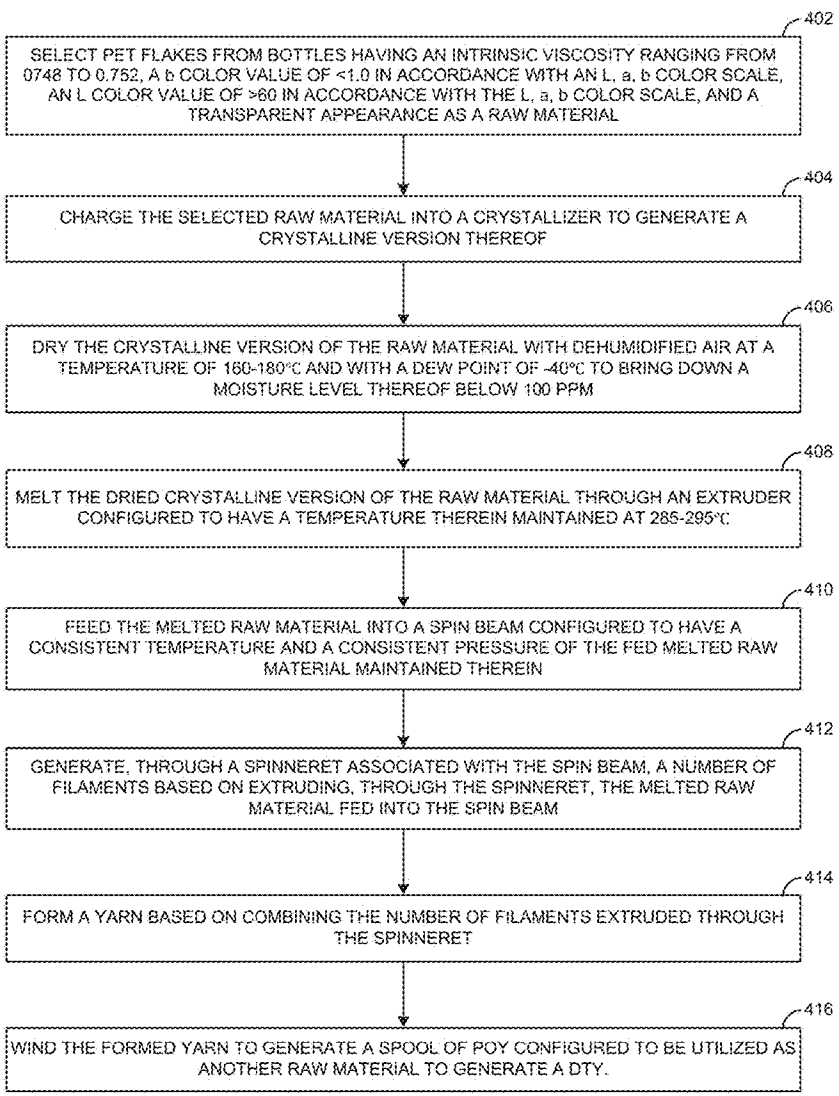
FIG. 4 is a process flow diagram detailing the operations involved in generating a POY from PET bottle flakes, according to one or more embodiments.

FIG. 4 shows a process flow diagram detailing the operations involved in generating a POY (e.g., POY 150) from bottle PET flakes (e.g., PET flakes 102), according to one or more embodiments. In one or more embodiments, operation 402 may involve selecting the bottle PET flakes having an intrinsic viscosity ranging from 0.748 to 0.752, a b color value of <1.0 in accordance with an L, a, b color scale, an L color value of >60 in accordance with the L, a, b color scale, and a transparent appearance as a raw material. In one or more embodiments, operation 404 may involve charging the selected raw material into a crystallizer (e.g., crystallizer 104) to generate a crystalline version (e.g., crystalline PET flakes 108) thereof.

In one or more embodiments, operation 406 may involve drying the crystalline version of the raw material with dehumidified air at a temperature of 160-180° C. and with a dew point of −40° C. to bring down a moisture level thereof below 100 ppm. In one or more embodiments, operation 408 may involve melting the dried crystalline version (e.g., dried crystalline PET flakes 112) of the raw material through an extruder (e.g., extruder 114) configured to have a temperature therein maintained at 285-295° C. In one or more embodiments, operation 410 may involve feeding the melted raw material (e.g., melted PET 116) into a spin beam (e.g., spin beam 122) configured to have a consistent temperature and a consistent pressure of the fed melted raw material maintained therein.

In one or more embodiments, operation 412 may involve generating, through a spinneret (e.g., spinneret $\mathbf{304}_{1\text{-}N}$) associated with the spin beam, a number of filaments $\mathbf{308}_{1\text{-}M}$ based on extruding, through the spinneret, the melted raw material fed into the spin beam. In one or more embodiments, operation 414 may involve forming a yarn (e.g., yarn 310) based on combining the plurality of filaments extruded through the spinneret. In one or more embodiments, operation 416 may then involve winding the formed yarn to generate a spool of the POY configured to be utilized as another raw material to generate a DTY (e.g., DTY 134).

Although the present embodiments have been described with reference to specific example embodiments, it will be evident that various modifications and changes may be made to these embodiments without departing from the broader spirit and scope of the various embodiments. Accordingly, other embodiments are within the scope of the following claims.

What is claimed is:

1. A method comprising:

selecting Polyethylene Terephthalate (PET) flakes from bottles having an intrinsic viscosity ranging from 0.748 to 0.752, a b color value of <1.0 in accordance with an L, a, b color scale, an L color value of >60 in accordance with the L, a, b color scale, and a transparent appearance as a raw material;

charging the selected raw material into a crystallizer to generate a crystalline version thereof;

drying the crystalline version of the raw material with dehumidified air at a temperature of 160-180° C. and with a dew point of −40° C. to bring down a moisture level thereof below 100 parts per million (ppm);

melting the dried crystalline version of the raw material through an extruder having a temperature therein maintained at 285-295° C.;

feeding the melted raw material into a spin beam having a consistent temperature and a consistent pressure of the fed melted raw material maintained therein;

generating, through a spinneret associated with the spin beam, a plurality of filaments based on extruding, through the spinneret, the melted raw material fed into the spin beam;

forming a yarn based on combining the plurality of filaments extruded through the spinneret;

winding the formed yarn to generate a spool of Partially Oriented Yarn (POY); and utilizing the generated spool of POY as another raw material to generate a Draw Texturized Yarn (DTY) having a denier of 50-500.

2. The method of claim 1, wherein charging the selected raw material into the crystallizer comprises charging the selected raw material into a hopper associated therewith.

3. The method of claim 1, further comprising passing the melted raw material through a filter capable of removing particles up to 40 microns in dimension prior to the feeding thereof into the spin beam.

4. The method of claim 1, further comprising cooling the plurality of filaments out of the spinneret at a temperature of 7-12° C. in conjunction with the combination thereof to form the yarn.

5. The method of claim 1, further comprising lubricating the plurality of filaments of the formed yarn using an oil applicator.

6. The method of claim 1, further comprising:

loading the generated spool of POY into a DTY machine comprising at least one heater, a temperature of the at least one heater being 180-190° C.

7. The method of claim 6, further comprising drawing the spool of POY through the at least one heater to generate the DTY having the denier of 50-500.

8. A method comprising:

selecting PET flakes from bottles having an intrinsic viscosity ranging from 0.748 to 0.752, a b color value of <1.0 in accordance with an L, a, b color scale, an L color value of >60 in accordance with the L, a, b color scale, and a transparent appearance as a raw material;

charging the selected raw material into a crystallizer to generate a crystalline version thereof;

drying the crystalline version of the raw material with dehumidified air at a temperature of 160-180° C. and with a dew point of −40° C. to bring down a moisture level thereof below 100 ppm;

melting the dried crystalline version of the raw material through an extruder having a temperature therein maintained at 285-295° C.;

feeding the melted raw material into a spin beam having a consistent temperature and a consistent pressure of the fed melted raw material maintained therein;

generating, through a plurality of spinnerets associated with the spin beam, a plurality of filaments through each spinneret based on extruding, through the each spinneret, the melted raw material fed into the spin beam;

forming a yarn based on combining the plurality of filaments extruded through the each spinneret with the plurality of filaments extruded through other spinnerets of the plurality of spinnerets;

winding the formed yarn to generate a spool of POY; and utilizing the generated spool of POY as another raw material to generate a DTY having a denier of 50-500.

9. The method of claim 8, wherein charging the selected raw material into the crystallizer comprises charging the selected raw material into a hopper associated therewith.

10. The method of claim 8, further comprising passing the melted raw material through a filter capable of removing particles up to 40 microns in dimension prior to the feeding thereof into the spin beam.

11. The method of claim 8, further comprising cooling the plurality of filaments out of the each spinneret at a temperature of 7-12° C. in conjunction with the combination thereof with the plurality of filaments out of the other spinnerets to form the yarn.

12. The method of claim 8, further comprising lubricating the plurality of filaments of the formed yarn using an oil applicator.

13. The method of claim 8, further comprising:

loading the generated spool of POY into a DTY machine comprising at least one heater, a temperature of the at least one heater being 180-190° C.

14. The method of claim 13, further comprising drawing the spool of POY through the at least one heater to generate the DTY having the denier of 50-500.

15. A method comprising:

selecting PET flakes from bottles having an intrinsic viscosity ranging from 0.748 to 0.752, a b color value of <1.0 in accordance with an L, a, b color scale, an L color value of >60 in accordance with the L, a, b color scale, and a transparent appearance as a raw material;

charging the selected raw material into a crystallizer to generate a crystalline version thereof;

drying the crystalline version of the raw material with dehumidified air at a temperature of 160-180° C. and with a dew point of −40° C. to bring down a moisture level thereof below 100 ppm;

melting the dried crystalline version of the raw material through an extruder having a temperature therein maintained at 285-295° C.;

passing the melted raw material through a filter capable of removing particles up to 40 microns in dimension;

feeding the filtered and melted raw material into a spin beam having a consistent temperature and a consistent pressure of the fed filtered and melted raw material maintained therein;

generating, through a spinneret associated with the spin beam, a plurality of filaments based on extruding, through the spinneret, the filtered and melted raw material fed into the spin beam;

forming a yarn based on combining the plurality of filaments extruded through the spinneret; and winding the formed yarn to generate a spool of POY; and utilizing the generated spool of POY as another raw material to generate a DTY having a denier of 50-500.

16. The method of claim 15, wherein charging the selected raw material into the crystallizer comprises charging the selected raw material into a hopper associated therewith.

17. The method of claim 15, further comprising cooling the plurality of filaments out of the spinneret at a temperature of 7-12° C. in conjunction with the combination thereof to form the yarn.

18. The method of claim 15, further comprising lubricating the plurality of filaments of the formed yarn using an oil applicator.

19. The method of claim 15, further comprising:

loading the generated spool of POY into a DTY machine comprising at least one heater, a temperature of the at least one heater being 180-190° C.

20. The method of claim 19, further comprising drawing the spool of POY through the at least one heater to generate the DTY having the denier of 50-500.

* * * * *